United States Patent [19]

Morrison

[11] Patent Number: 4,782,553

[45] Date of Patent: Nov. 8, 1988

[54] DOOR STOP

[76] Inventor: Steven P. Morrison, 8533 Hawthorne, Alta Loma, Calif. 91701

[21] Appl. No.: 63,002

[22] Filed: Jun. 17, 1987

[51] Int. Cl.[4] ..... E05F 5/02

[52] U.S. Cl. ..... 16/86 A; 292/DIG. 15; 267/140

[58] Field of Search ..... 16/85, 86 R, 86 A, 114 R, 16/114 A, 118, DIG. 24, DIG. 40; 49/460, 461, 462; 292/DIG. 8, DIG. 15, DIG. 19; 267/139, 140; 411/901, 902, 903

[56] References Cited

U.S. PATENT DOCUMENTS

| | | | |
|---|---|---|---|
| D. 178,366 | 7/1956 | Heyer | D8/402 |
| 511,662 | 12/1893 | McElroy | 16/85 |
| 2,189,048 | 2/1940 | Underhill | 16/86 A |
| 2,596,780 | 5/1952 | Meyers et al. | 16/86 A |
| 2,700,788 | 2/1955 | Hennelly | 16/86 A |
| 2,760,224 | 8/1956 | Hennelly | 16/86 A |
| 2,767,421 | 10/1956 | Fremstad | 16/85 |
| 3,172,144 | 3/1965 | Jamison | 16/86 A |

*Primary Examiner*—Nicholas P. Godici
*Assistant Examiner*—Edward A. Brown
*Attorney, Agent, or Firm*—Boniard I. Brown

[57] ABSTRACT

A door stop having an elongate, one piece yieldable plastic body and a mounting screw extending from one end of the body. The body includes a base portion in which the mounting screw is firmly anchored and a shank extending from and having a reduced neck adjacent the base portion. The body yields longitudinally without buckling upon impact of a door against the stop to cushion the impact, and bends laterally at the reduced neck upon lateral contact of an object with the stop. The stop is devoid of separable parts or sharp edges which might injure persons, particularly children, who come into contact with the stop, and preferably utilizes as the mounting screw a screw eye about which the plastic body may be molded to firmly join the body and screw.

3 Claims, 1 Drawing Sheet

DOOR STOP

BACKGROUND OF THE INVENTION

1. Field of the Invention

This invention relates generally to door hardware and more particularly to an improved door stop.

2. Prior Art

Simply stated a door stop is a device to be mounted behind a door to arrest opening movement of the door before the door or its handle strikes an adjacent wall or other member behind the door. Some door stops are secured to the floor. Other stops are secured to the wall or support behind the door. This invention is concerned with door stops of the latter kind. For convenience, this latter kind of door stop is referred to as a wall mounted stop, although the stop may be secured to other than a wall.

Wall mounted door stops are available in at least two different types. One type is a rigid stop constructed of metal with a cushion tip at one end and a screw at the other end to be threaded in the wall or other support. The other type comprises a flexible coil spring-like extension having a cushion tip at one end and a screw at the other end.

Both of these existing stops are installed by threading their screws into a wall or other support behind a door in such a way that opening movement of the door is arrested by contact of the door against the cushion tip of the stop. The rigid stop has a disadvantage in that because of its rigid non-yeilding construction, it may damage the door if the door strikes the stop with even a relatively light impact, notwithstanding the cushion tip on the stop. Moreover, the stop is not laterally yieldable and may break if contacted by an object which produces a lateral impact on the stop. Also, the stop may cause injury to a child or other person who accidently contacts the stop, particurlary if its cushion tip has separted from the stop.

The spring coil stop avoids such impact damage to the door, but suffers from the disadvantage that it often bends or buckles under the impact of the door, thus allowing the door to strike the protected wall or other protected object. Both of these existing stops suffer from the disadvantages that they tend to collect dirt and/or corrode. The cushion tips of the stops tend to separate from the stops, thus rendering the stops essentially useless since the non-cushioned stops will wear the door.

Accordingly,a definite need exists for an improved door stop which is free of the noted problems.

SUMMARY OF THE INVENTION

The improved door stop of this invention has a one piece unitary body including an elongate shank and an enlarged base portion at one end of the shank. Extending from this base portion is a screw to be threaded into a wall or other support behind a door to be stopped. The opposite end of the shank has an end face for contact with the door to be stopped.

According to the one feature of the invention, the one piece body of the door stop is molded or otherwise formed from an elastically yieldable plastic, such as polyethylene plastic. When a door strikes the stop, the plastic body yields slightly to stop the door with a cushioned action which avoids damage to the door. Moreover, the one piece unitary structure of the stop eliminates the need for a separate cushion top on the shank which could separate from the stop.

Another feature of the invention resides in the fact that the shank of the stop has a neck of reduced cross-section at which the shank bends if contaced by an object which produces a lateral force on the shank. Breaking of the shank is thus avoided,as is the possibility of injury to a child or older person who accidentally contacts the stop. Being elastically yieldable,the stop returns to its initial unstressed position when the force is removed.

According to a preferred feature of the improved stop, its mounting screw is a screw eye whose ring is embedded or molded within the plastic of the stop body. The screw is thus firmly anchored against separating or rotation relative to the body.

The stop is also pleasing in appearance, may be made in various colors and will not corrode or collect dirt.

DESCRIPTION OF PREFERRED EMBODIMENT

Figure 1:
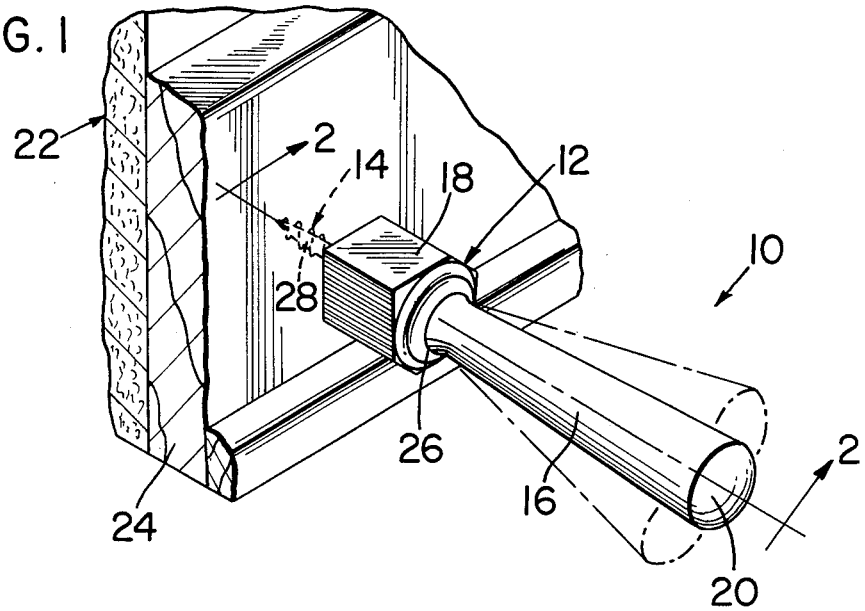
FIG. 1 is a perspective view of a stop according to the invention installed on a wall base board.
Figure 2:
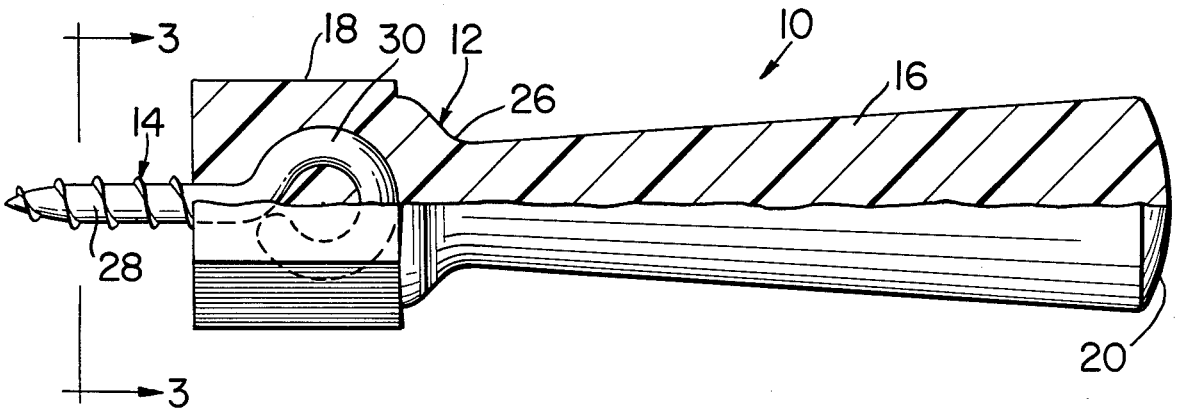
FIG. 2 is an enlarged side elevation, partly in section, of the stop.
Figure 3:
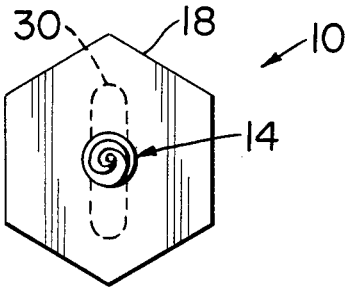
FIG. 3 is a view looking in the direction of the arrows 3—3 in FIG. 2.

Turning now to these drawings, the improved door stop 10 of the invention has a one piece unitary body 12 and a mounting screw 14. The stop body 12 includes an elongate shank 16 and an enlarged base portion 18 at one end of the shank. The opposite end of the shank has a convexly rounded end face 20 which forms a tip of the shank for contact by a door to be stopped.

The door stop 10 is installed behind a door (not shown) by threading the screw 14 into a support 22. In the drawings, the support 22 is a wall 22 or more precisely the baseboard 24 of the wall. The stop is installed in the path of opening movement of the door in such a way that one side of the door strikes the end piece 20 of the door stop shank 16 approximately at right angles to the longitudinal axis of the shank. The door then produces a longitudinal impact on the door stop.

According to one feature of the invention the one piece unitary body 12 of the door stop is molded or otherwise fabricated from an elastically yieldable plastic, such as polyethylene plastic. When the door strikes the end face 20 of the stop shank 12, the latter yields longitdinally slightly to cushion the impact of the door without damaging the door. The shank is sufficiently stiff, however, so that it does not buckle or deflect laterally in a manner which might allow the door to strike and mar the wall.

Another feature of the invention resides in the fact that the shank 16 of the door stop has a neck 26 of reduced cross-section where the shank bends, as indicated by the broken lines in FIG. 1, if subjected to a lateral force or impact. This avoids breaking the door stop if accidentally struck by an object such as a vacumn cleaner,as well as injury to a child or other person who may accidentally contact the stop. Such lateral deflection of the shank creates elastic strain energy in the shank which restores it to its normal unstressed position coaxial with the screw 14 when the force is removed.

Another important feature of the invention is concerned with the mounting screw 14 and its attachment to the door stop body 12. The screw is a so-called screw eye having a threaded shank 28 and a loop or ring 30 at one end of the screw shank. This ring is embedded within the plastic material of the door stop body 12, more particularly its base portion 18, as by being molded within the body. The plastic material surrounds and fills the opening in the ring 30 to firmly anchor the screw 14 to the body 12.

The base portion 18 of the door stop body 12 is preferably provided with flat sides,as by being made hexagonal in cross-section for engagement with a wrench for threading the screw 14 into the wall 22.

When the door stop 10 is properly installed, a door striking the stop will be arrested before it strikes the wall. To this end, the shank 16 is sized in cross-section such that impact of the door against the shank 16 will not laterally deflect or buckle the shank in a manner which would allow the door to strike the wall. If an object contacts the stop laterally, however, the shank will bend or deflect laterally at its neck 26 in a manner to prevent breaking of the shank or injury to a person.

I claim:

1. A door stop comprising:

an elongated one piece unitary body including an elongate normally substantially straight shank having a tip at one end and a base portion at the other end of said shank adapted to engage a support, a fastener secured to and extending from said base portion longitudinally of said body to engage in the support, said shank being tapered to a diminishing diameter toward said base portion and having a minimum diameter cross-section contiguous to said base portion forming a neck, and wherein the material of the entire body comprises an elastically yieldable plastic having a resiliency such that said body will yield longitudinally without lateral deflection to cushion longitudinal impact of a door against said shank tip and the shank will bend laterally at said neck upon application of a lateral force to the shank and then return to its normal, substantially straight configuration upon removal of said lateral force.

2. A door stop according to claim 1, wherein:

said shank is uniformly tapered to a diminishing diameter from said tip to said neck.

3. A door stop comprising:

an elongated one piece unitary body including an elongate normally substantially straight shank having a tip at one end and a base portion at the other end of said shank adapted to engage a support, a fastener secured to and extending from said base portion longitudinally of said body to engage in the support, said fastener comprises a screw eye having a ring at one end embedded in said base portion with the plastic material of said body extending through the opening in the screw eye to firmly anchor the screw to said body.

said shank being tapered to a diminishing diameter uniformly from said tip to said base portion, whereby said shank has a minimum diameter cross-section contiguous to said base portion and forming a neck, and wherein the material of the entire body comprises an elastically yieldable plastic having a resiliency such that said body will yield longitudinally without lateral deflection to cushion longitudinal impact of a door against said shank tip and the shank will bend laterally at said neck upon application of a lateral force to the shank and then return to its normal, substantially straight configuration upon removal of said lateral force.

* * * * *